US005842691A

United States Patent [19]

Nakamura

[11] Patent Number: 5,842,691

[45] Date of Patent: Dec. 1, 1998

[54] IMAGE FORMATION APPARATUS

[75] Inventor: Hiroyuki Nakamura, Ebina, Japan

[73] Assignee: Fuji Xerox Co., Ltd., Tokyo, Japan

[21] Appl. No.: 783,231

[22] Filed: Jan. 14, 1997

[30] Foreign Application Priority Data

Jan. 18, 1996 [JP] Japan ..... 8-006838

[51] Int. Cl.[6] ..... B65H 3/52

[52] U.S. Cl. ..... 271/122; 271/188; 271/274; 271/121

[58] Field of Search ..... 271/121, 122, 271/124, 125, 109, 188, 274

[56] References Cited

U.S. PATENT DOCUMENTS

| | | | |
|---|---|---|---|
| 1,437,843 | 12/1922 | Heinrichs | 271/274 |
| 2,655,374 | 10/1953 | Townsley | 271/125 |
| 5,050,854 | 9/1991 | Tajima | 271/109 |
| 5,172,899 | 12/1992 | Tajima | 271/125 |

FOREIGN PATENT DOCUMENTS

U-1-180440 6/1963 Japan .

A-5-69964 3/1993 Japan .

*Primary Examiner*—H. Grant Skaggs
*Attorney, Agent, or Firm*—Oliff & Berridge, PLC

[57] ABSTRACT

An image formation apparatus comprising:

a main unit including an image formation section;

a sheet storage section being disposed in said main unit for storing a large number of stacked sheets;

feed means for giving a transport force to the sheets in said sheet storage section in a predetermined direction from said sheet storage section;

a friction member being placed facing said feed means so that it comes in elastic contact with said feed means for forming a nip portion for separating sheets transported in overlapped relation; and a support member for forming said friction member with a projection projecting from said nip portion in either one direction orthogonal to a transport direction of the sheet for said feed means and supporting said friction member.

8 Claims, 9 Drawing Sheets

IMAGE FORMATION APPARATUS

BACKGROUND OF THE INVENTION

This invention relates to an image formation apparatus using an electrophotographic process, such as a copier or a printer, and in particular to an art of a paper feeder for supplying sheets stored in a paper feed tray to an image formation section one sheet at a time.

A general image formation apparatus such as a copier using an electrophotographic process supplies sheets to an image formation section one sheet at a time by a paper feeder and forms an image on the sheet by the image formation section, then discharges the sheet to the outside of the apparatus. An of ten used paper feeder is made up of a paper feed tray mounted detachably on the main unit of an image formation apparatus for storing a large number of sheets in a state in which they are stacked substantially horizontally and paper feed rolls for drawing out one sheet from the paper feed tray and supplies the sheet to an image formation section. Normally, the paper feed rolls are disposed at an end in the sheet supply direction in the paper feed tray and comprise a feed roll coming in contact with the top face of the top sheet stored in the paper feed tray and a retard roll facing the feed roll. These rolls form a nip portion with peripheral surfaces coming in contact with each other for allowing a sheet to pass through. The feed roll rotates in the supply direction for drawing out a sheet and the retard roll rotates in an opposite direction to the supply direction to prevent more than one sheet from being drawn out in overlapped relation.

By the way, shaft members for rotatably supporting the rolls often have a so-called one support structure with only one axial end supported on the deep side in the apparatus mainly for simplifying the configuration or facilitating replacement of the rolls. This structure eliminates the need for supporting both ends of the shaft member and enables the operator to open a front cover of the apparatus and easily replace the roll. However, if the rolls are supported in such a one support structure, the contact pressure between front and deep rolls, namely, the nip pressure easily becomes uneven and tends to lessen as the position comes to the front. Such an unbalanced nip pressure results in transport attitude disorder, a so-called skew wherein a plurality of sheets of paper enter the nip on the front side of the sheet, whereby transport resistance on the front side lessens and the transport force on the front side substantially grows and the sheet is transported in a skewed state in which the tip of the sheet is directed toward the deep side.

Then, to correct such an evil effect produced by supporting the roll at one end, an art of forming one roll like a taper (cone) to make the nip pressure uniform is proposed in the Unexamined Japanese Utility Model Application Publication No. Hei. 1-180440. Also, a both-support structure wherein the opposite end to the one support portion of a shaft member is supported by a detachable auxiliary bracket and both ends are supported at the operation time is described in the Unexamined Japanese Patent Application Publication No. Hei. 5-69964.

To form one roll like a taper as in the former, the large diameter side of the roll is placed on the side toward which the nip pressure lessens for making the nip pressure uniform. Therefore, to build the roll in an apparatus, the directionality of the roll is limited. The feed and retard rolls cannot be made common. Thus, flexibility of assembly is limited and the manufacturing costs are increased. In the latter, the auxiliary bracket for supporting the opposite end to the one support portion is newly provided, whereby the number of parts is increased and the structure is complicated. This is also accompanied by an increase in the manufacturing costs.

SUMMARY OF THE INVENTION

It is therefore an object of the invention to provide an art for enabling a skew to be suppressed without increasing manufacturing costs in an image formation apparatus comprising a paper feeder with shaft members of a one support structure.

To the end, according to the invention, there is provided an image formation apparatus comprising a main unit provided with an image formation section, a sheet storage section being disposed in the main unit for storing a large number of stacked sheets, feed means for giving a transport force to the sheets in the sheet storage section in a predetermined direction from the sheet storage section, a friction member being placed facing the feed means so that it comes in elastic contact with the feed means for forming a nip portion for separating sheets transported in overlapped relation, and a support member for forming the friction member with a projection projecting from the nip portion in either one direction orthogonal to a transport direction of the sheet for the feed means and supporting the friction member.

According to the invention, a sheet fed from the sheet storage section by the feed means passes through the nip portion between the feed means and the friction member and is transported in a predetermined direction. At this time, if a plurality of sheets are about to enter the nip portion, transport of the sheets not coming in contact with the feed means is blocked by the friction member. The feed means abuts the friction member, whereby the projection of the friction member swells to the friction member side and the swell regulates motion in the projection direction, of the sheet passing through the nip portion, whereby a skew in which the transport attitude is disordered is suppressed. Therefore, if a skew leans to one side, the projection may be formed on the side suppressing the skew.

According to the invention, a skew is suppressed simply by forming a projection in the friction member without changing the roll shape or adopting a both-support structure for the rolls as in the conventional apparatuses. Resultantly, the number of parts does not increase and the structure is not complicated; the manufacturing costs can be reduced.

DETAILED DESCRIPTION OF THE PREFERRED EMBODIMENTS

Referring now to the accompanying drawings, there are shown preferred embodiments of the invention.

First embodiment

A: Configuration of First embodiment

Figure 1:
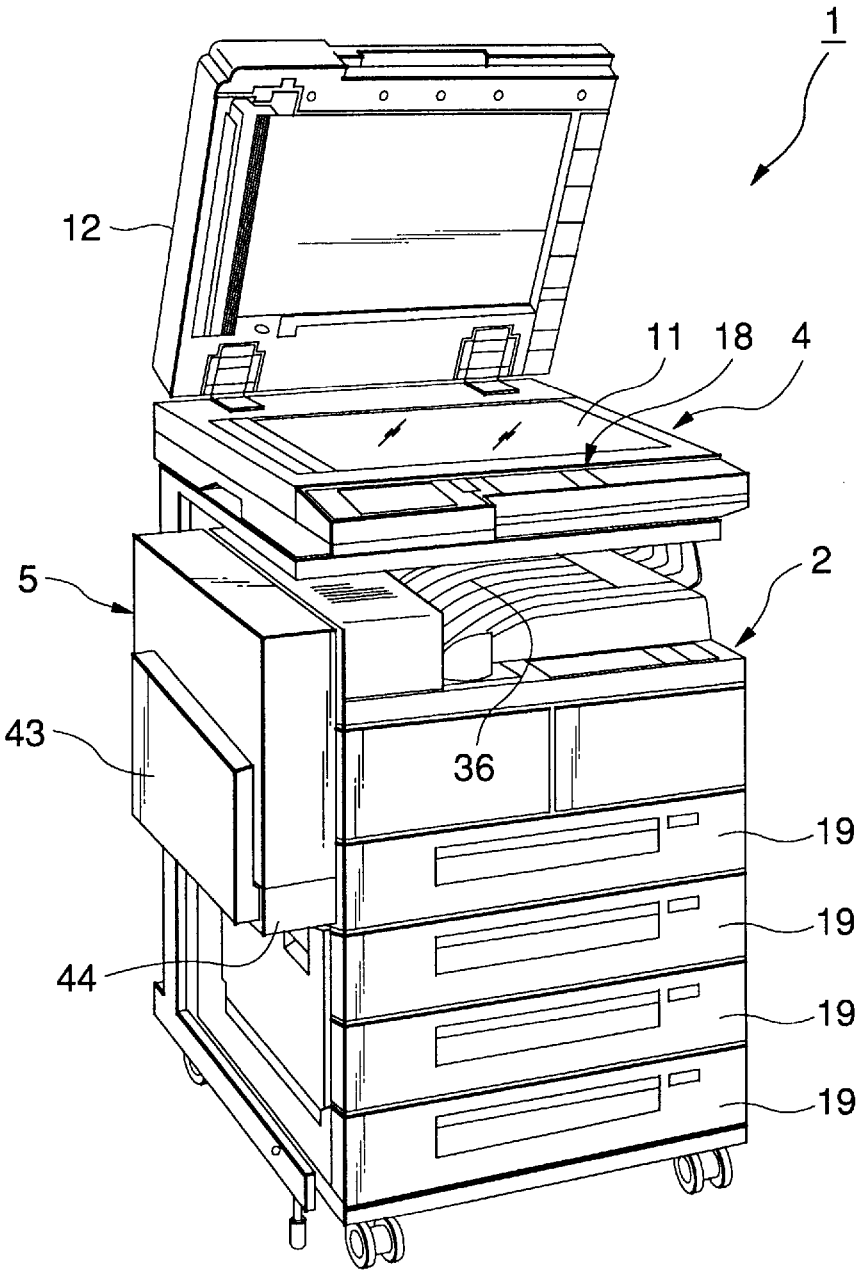
FIG. 1 is a general perspective view of a copier of a first embodiment of to the invention.
Figure 2:
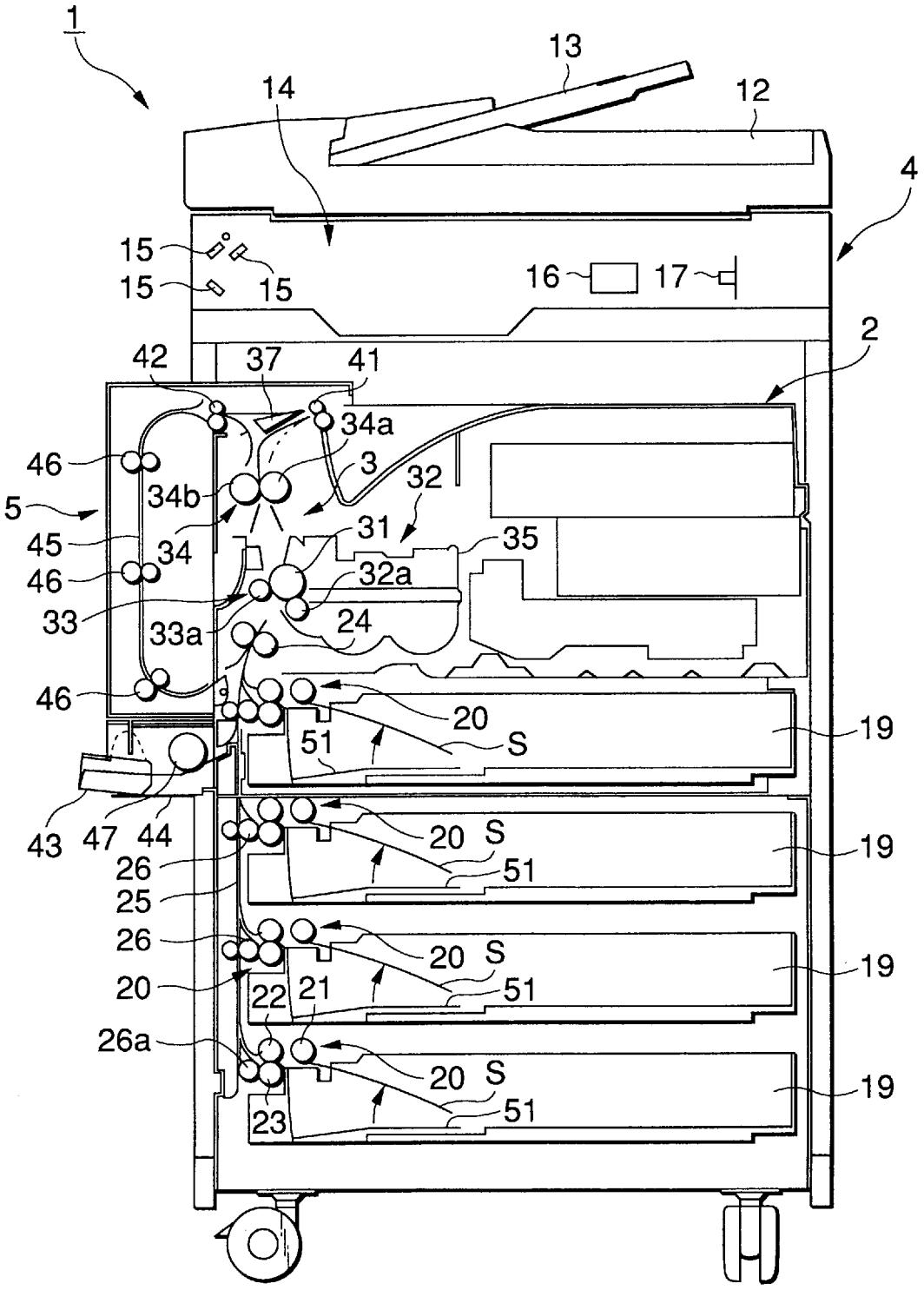
FIG. 2 is a front view of the copier of the first embodiment of to the invention.

FIGS. 1 and 2 are a perspective view and a front view of a copier (image formation apparatus) 1 according to the invention. The copier 1 comprises a main unit 2 having a shell made of a cabinet like a rectangular parallelopiped vertically long, an image formation section 3 disposed in the main unit 2, an original bed 4 disposed on the top of the main unit 2, and an automatic double-sided unit 5 attached to the left side face of the main unit 2.

An original document is set on copy glass 11 disposed on the top of the original bed 4 with an image placed face down. An original cover 12 for holding an original document (not shown) pressed from above is connected at the deep end in the main unit 2 to the original bed 4 by hinges, thereby being attached to the original bed 4 so that it can be opened and closed. The original cover 12 contains an automatic original feeder (not shown) for automatically feeding an original document onto the copy glass 11 and discharging the original document onto the original cover 12 after copying. To use the automatic original feeder, an original document is stored in an original tray 13 with an image placed face up. That is, the copier 1 enables the user to set an original document on the copy glass 11 in a manner that the user opens the original cover 12, places the original document on the copy glass 11, and closes the original cover 12 for pressing the original document or that the user stores the original document in the original tray 13. The original tray 13 can store only sheet-like original documents of a predetermined size or smaller, but can store a plurality of original sheets (for example, about 30 sheets) at a time for enabling consecutive copying by the automatic original feeder.

The original bed 4 contains a reader 14 for optically reading the image of an original document set on the copy glass 11. As shown in FIG. 2, the reader 14 is made up of a light source lamp (not shown) for irradiating an original document with laser light through the copy glass 11, a plurality of reflection mirrors 15 . . . for reflecting light reflected from the original document, a lens 16 disposed in a light path of the reflected light by the reflection mirrors 15 . . . , and an image sensor 17 such as CCD on which the reflected light passing through the lens 16 is incident. When the reflected light by the reflection mirrors passes through the lens 16, it forms an image on the image sensor 17 through the lens 16. The image sensor 17 executes photoelectric conversion of the reflected light and outputs a light signal based on the photoelectric conversion onto a photosensitive drum 31 forming a part of the image formation section 3, whereby an electrostatic latent image based on the image is formed on the photosensitive drum 31.

As shown in FIG. 1, an operation panel 18 is placed on the front top face of the original bed 4. It is provided with operation buttons and function setting and selection keys of copy start/stop, sheet S size selection or automatic size setting mode, copy image light and dark, copy image magnification, single-sided copy mode, double-sided copy mode, etc.

A plurality of paper feed trays (sheet storage sections) 19 (in this case, four) for storing sheets S by size or feed direction are inserted detachably into the lower side of the main unit 2 so that they are arranged from top to bottom. Each paper feed tray 19 stores a large number of sheets S stacked on each other and is inserted into the main unit 2 from the front of the main unit 2 (the drawing front in FIG. 2). As shown in FIG. 2, the main unit 2 is provided with paper feed rolls 20 for feeding the top sheet S stored in the paper feed tray 19 into the image formation section 3 for each paper feed tray 19. The paper feed rolls 20 are disposed on the left, which is the sheet S feed direction, with respect to the paper feed tray 19. They consist of a naja roll 21 for drawing out the top sheet S in the paper feed tray and a roll pair of a feed roll (feed means, first rotation member, first roll member) 22 and a retard roll (friction member, second roll member) 23 for receiving the sheet S drawn out from the naja roll 21 and feeding it in the direction of the image formation section 3. The sheet S fed by means of the paper feed rolls 20 arrives at a registration roll 24 where the sheet S is adjusted in transport attitude and transport timing, then is fed into the image formation section 3.

A sheet transport passage 25 along the left side face of the main unit 2 is formed from the bottom paper feed tray 19 to the registration roll 24. Three transport rolls 26 are disposed in the sheet transport passage 25 adjacent to the paper feed rolls 20. The sheets S in the bottom paper feed tray 19 are transported throughout the length of the sheet transport passage 25 and the sheets S in other three paper feed trays 19 are merged at an intermediate point of the sheet transport passage 25 and are transported to the image formation section 3.

The sheet S fed by the paper feed rolls 20 from one paper feed tray 19 rises along the sheet transport passage 25 and arrives at the registration roll 24 by which the sheet S is transported to the image formation section 3.

As shown in FIG. 2, the image formation section 3 is made up of the photosensitive drum 31, a developing unit 32 for visualizing, namely, developing an electrostatic latent image formed on the photosensitive drum 31 in a developer of toner, etc., a transfer unit 33 for transferring the image developed on the photosensitive drum 31 to a sheet S, and a fuser 34 for fixing the image transferred to the sheet S thereon. The photosensitive drum 31 and the developing unit 32 are integrally built in a detachable cartridge 35 that can be attached to and detached from the main unit 2. This cartridge 35 also serves as a tank for storing a developer and is replaced with a new one upon consumption of the developer. The developing unit 32 consists of the cartridge 35 and a developing roll 32*a* for supporting the developer in the cartridge 35 and transferring the developer to the photosensitive drum 31. The transfer unit 33 is made of a transfer roll 33*a* placed facing the photosensitive drum 31. The sheet S is fed from the registration roll 24 into the space between the transfer roll 33*a* and the photosensitive drum 31. While the sheet S passes through between the transfer roll 33*a* and the photosensitive drum 31, the image developed on the photosensitive drum 31, namely, the developer is transferred onto the sheet S electrostatically. The fuser 34 is a combination of a heating roll 34*a* and a pressurizing roll 34*b* coming in contact with the heating roll 34*a* at proper pressure. The sheet S passes through between both the rolls 34*a* and 34*b*, whereby the transferred image is heated and pressurized and fixed on a first face of the sheet S. The copying is now complete.

In a single-sided copy mode, the sheet S passing through the fuser 34 and having the image copied to the first face is discharged by a first paper discharge roll 41 onto a paper discharge tray 36 formed on the top face of the main unit 2 with the first face to which the image is copied, placed face down. A transport passage of the sheet S from the fuser 34 via the first paper discharge roll 41 to the paper discharge tray 36 is defined by a gate 37 for switching the sheet S transport passage according to the single-sided or double-sided copy mode. In the double-sided copy mode, when the sheet S is once transported to the paper discharge tray 36 and arrives at a position at which the rear end of the paper sheet S is held by the paper discharge roll 41, the gate 37 is switched and the first paper discharge roll 41 is reversed and the sheet S is inverted with the rear end changed to the front end and is fed into a second paper discharge roll 42 from which the sheet S is transported to the automatic double-sided unit 5.

The automatic double-sided unit 5 has a shell made of a comparatively thin cabinet having a depth slightly smaller than that of the main unit 2 and is placed facing the left side face of the main unit 2. Below the automatic double-sided unit 5, a support unit 44 of a manual feed tray 43 is fixed to the main unit 2. The automatic double-sided unit 5 is connected at the lower end to the support unit 44 by hinges and has the upper end as a free end so that it can be opened and closed for the main unit 2. The main unit 2 and the automatic double-sided unit 5 are provided with a stopper (not shown) for holding a normally equipped state, a closed state of the automatic double-sided unit 5 and a stopper (not shown) for holding an open state at a predetermined angle.

A circular transport passage 45 for double-sided copying is disposed in the automatic double-sided unit 5 from top to bottom. It is equipped with a plurality of transport rolls 46 for transporting sheets S. The circular transport passage 45 has openings made on the face of the automatic double-sided unit 5 opposite to the main unit 2. In the normally equipped state, the upper opening is opposite to the second paper discharge roll 42 and the lower opening faces the upper end of the sheet transport passage 25. In the double-sided copy mode, a sheet S is fed from the second paper discharge roll 42 into the circular transport passage 45, is transported downward by the transport roll 46, and again is supplied to the sheet transport passage 25 in the main unit 2. After this, the sheet S passes through the same passage as in the single-sided copy mode and an image is copied to a second face of the sheet S by the image formation section 3, then the sheet S is discharged to the paper discharge tray 36 with the second face placed face down. If trouble such as a jam occurs in the automatic double-sided unit 5 during the double-sided copy mode, the automatic double-sided unit 5 is opened for handling the trouble.

The manual feed tray 43 for manually feeding a sheet S is attached pivotably to the support unit 44. A feed roll 47 is disposed in the support unit 44. A sheet S set on the manual feed tray 43 is supplied by the feed roller 47 to a position just before the uppermost transport roll 26 in the sheet transport passage 25 and a copy is made to one or both sides of the sheet S as described above, then the sheet S is discharged to the paper discharge tray 36. The manual feed tray 43 is connected at the lower end to the support unit 44 by hinges so that it can be opened and closed. When the manual feed tray 43 is used, it is opened to the left; when the manual feed tray 43 is not used, it is closed and can be stored on the outer side face of the automatic double-sided unit 5.

Next, the paper feed trays 19 and the paper feed rolls 20 will be discussed in detail.

Figure 6:
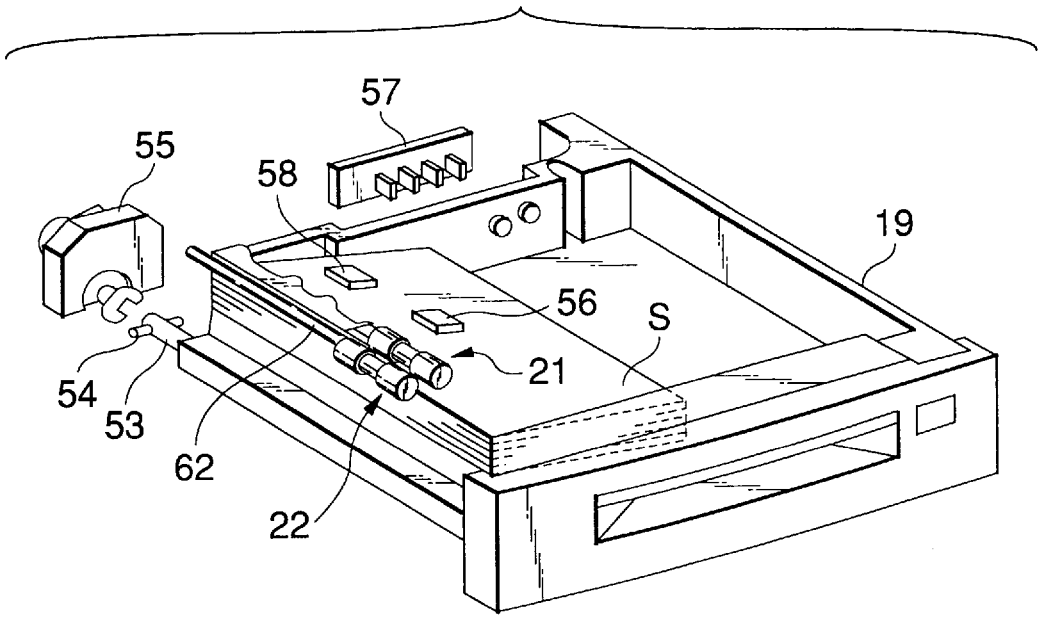
FIG. 6 is a perspective view of a paper feed tray.

As shown in FIG. 2, a bottom plate 51 is disposed on the sheet S feed side (left) on the bottom of each paper feed tray 19 and sheets S are placed on the bottom plate 51. The bottom plate 51 is connected at the end of the opposite feed side to the bottom of the paper feed tray 19 by hinges and can be turned from top to bottom on the feed side and a lift plate (not shown) is inserted below the turn end. The lift plate turns as a lift bar 53 projecting to the deep side of the paper feed tray 19 turns axially, as shown in FIG. 6, whereby the bottom plate 51 is turned upward and is lifted up. The lift bar 53 is connected to a lift-up motor 55 via a joint 54 and is turned by the operation of the lift-up motor 55. As the bottom plate 51 is lifted up, the feed side end of sheets S are lifted up and the top sheet S comes in contact with the lower peripheral surface of the naja roll 21, one of the paper feed rolls 20.

As shown in FIG. 6, the main unit 2 is provided with a no paper sensor 56 for sensing whether or not a sheet S exists in the paper feed tray 19, a size sensor 57 for sensing the size and storage orientation of a sheet S stored in the paper feed tray 19, and a face control sensor 58 for sensing whether or not the top sheet S is in contact with the naja roll 21 when the bottom plate 51 is lifted up as described above for each paper feed tray 19 inserted. The events sensed by the sensors 56, 57, and 58 are displayed on the operation panel 18, enabling the user to replenish sheets S, select one of the paper feed tray 19, check for a paper feed error, etc.

Next, the paper feed rolls 20 will be discussed with reference to FIGS. 2 to 8.

Figure 5:
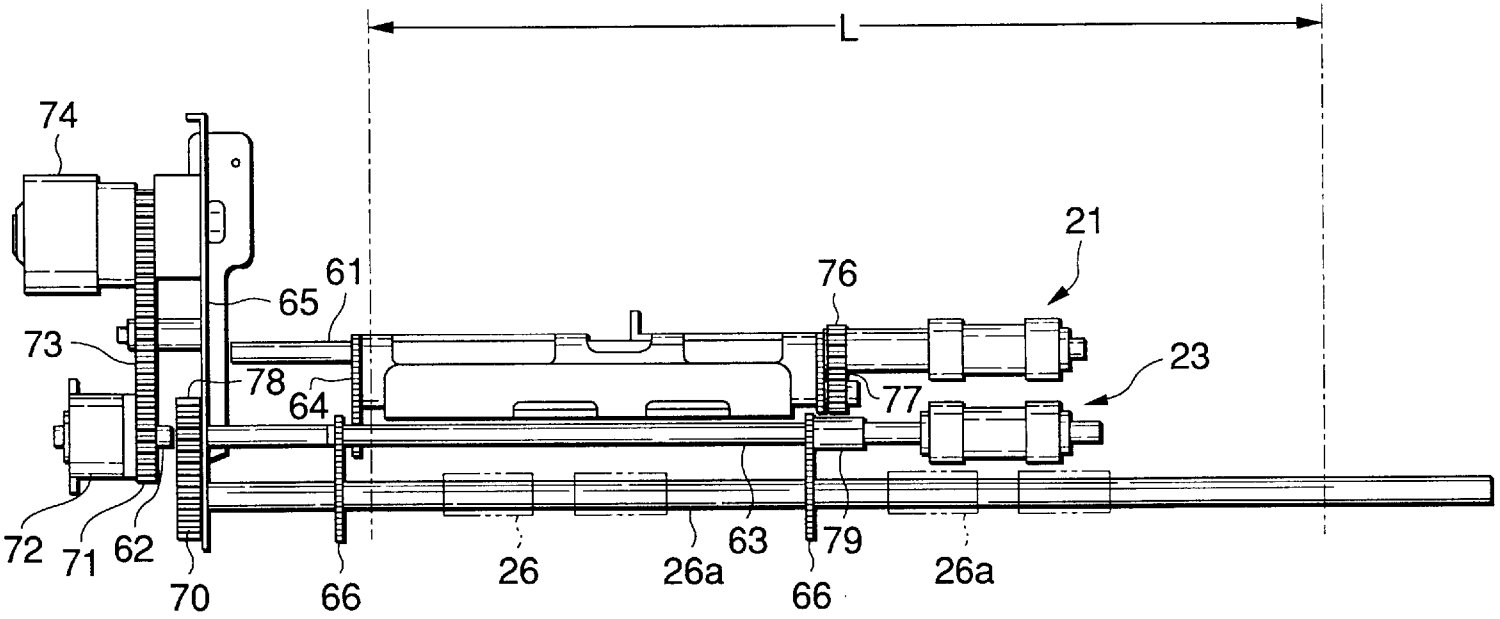
FIG. 5 is a top view of the paper feed rolls and their peripheral devices with the feed roll omitted.

As described above, the paper feed rolls 20 consist of the three rolls: The naja roll 21 for drawing out the top sheet S in the paper feed tray 19 and a roll pair of the feed roll 22 and the retard roll 23 for receiving the sheet S drawn out from the naja roll 21 and feeding it in the direction of the image formation section 3. In FIG. 5, L denotes the maximum width of sheets S fed from the paper feed tray 19 and the paper feed rolls 20 are offset to the front side from the center of the maximum width L with respect to the paper feed tray 19.

Figure 4:
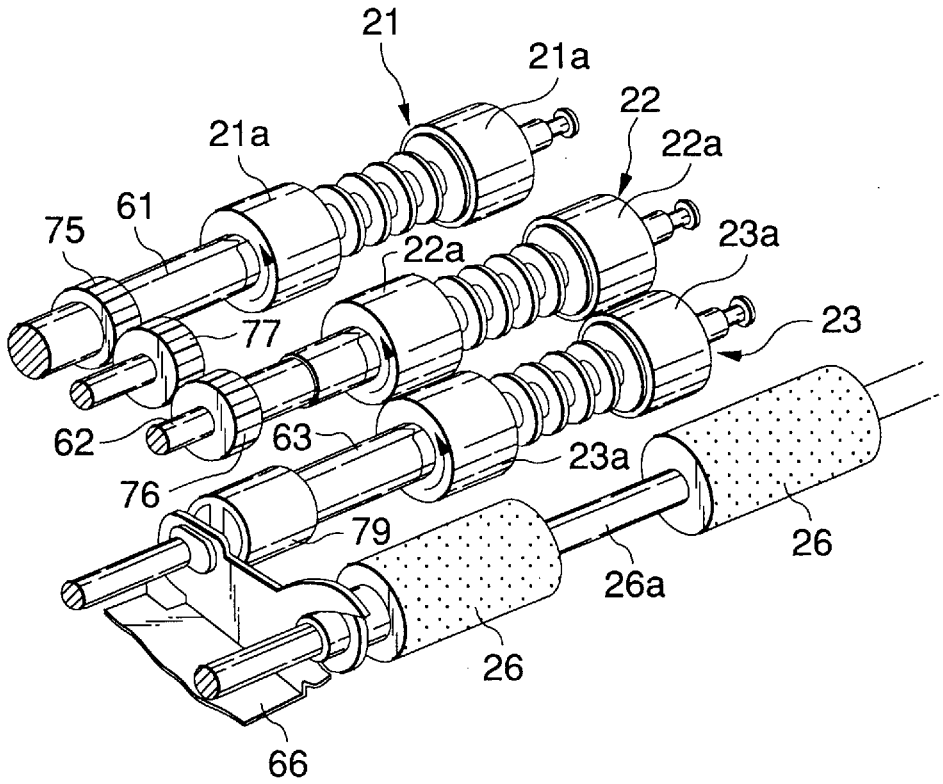
FIG. 4 is a perspective view of the paper feed rolls.

The rolls 21, 22, and 23 of the paper feed rolls 20 are rolls of the same shape and the same size. As shown in FIG. 4, both axial ends of each roll is made slightly larger in diameter with elastic bodies on the surface than the center and the large diameter parts 21*a*, 22*a*, and 23*a* act on the sheet S substantially. The rolls 21, 22, and 23 are fixed coaxially to the front ends of a naja roll shaft 61, a feed roll shaft (first shaft member) 62, and a retard roll shaft (support member, second shaft member) 63 parallel with each other extending from the deep side of the main unit 2 to the front. The naja roll shaft 61 and the feed roll shaft 62 are supported rotatably on an arm (support portion) 64 attached to the main unit 2. These two roll shafts 61 and 62 project from the arm 64 to the deep side and front side and the naja roll 21 and the feed roll 22 are fixed to the front projection ends. The deep end of the feed roll 22 is supported on a machine frame 65 coupled and fixed to the main unit 2. The naja roll shaft 61 and the feed roll shaft 62 are of a one support structure with the axial deep side supported on the arm 64 or the arm 64 and the machine frame 65.

Reference numeral 26*a* in FIGS. 4 and 5 is a roll shaft of the transport rolls 26 disposed in the sheet transport passage 25 on the side approaching the retard roll 23. The roll shaft 26*a* is supported at both ends rotatably on the machine frame 65. A retard bracket (support portion) 66 forming a part of the main unit 2 is supported pivotably on the roll shaft 26*a*.

Figure 7:
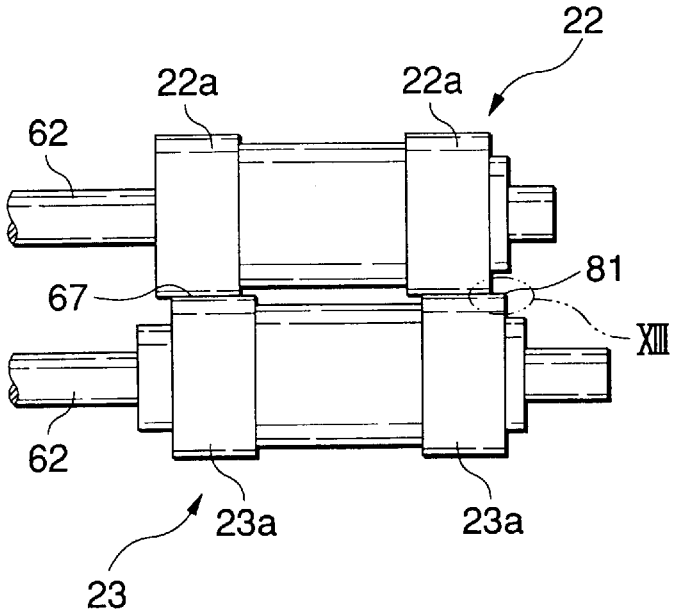
FIG. 7 is a side view to show a state in which the retard roll comes in contact with the feed roll.

The retard roll shaft 63 is supported rotatably at the right of the retard bracket 66 (upper side in FIG. 5) ; The retard roll shaft 63 rotates with rotation of the retard bracket 66 and normally the retard roll 23 exists at a position downwardly apart from the feed roll 22 (not shown in FIG. 5). When a sheet S is fed, the opposite retard roll shaft 63 side of the retard bracket 66 is energized downward by an energization member (not shown), whereby the retard roll shaft 63 rotates upward, whereby as shown in FIG. 7, the retard roll 23 comes in elastic contact with the feed roll 22, forming nip portions 67 between both the rolls 22 and 23. The operation of the retard roll 23 coming in contact with the feed roll 22 is performed in synchronization with the insertion operation of the paper feed tray 19 into the main unit 2. The retard roll shaft 63 is of a one support structure with the axial deep side supported on the retard bracket 66.

Figure 3:
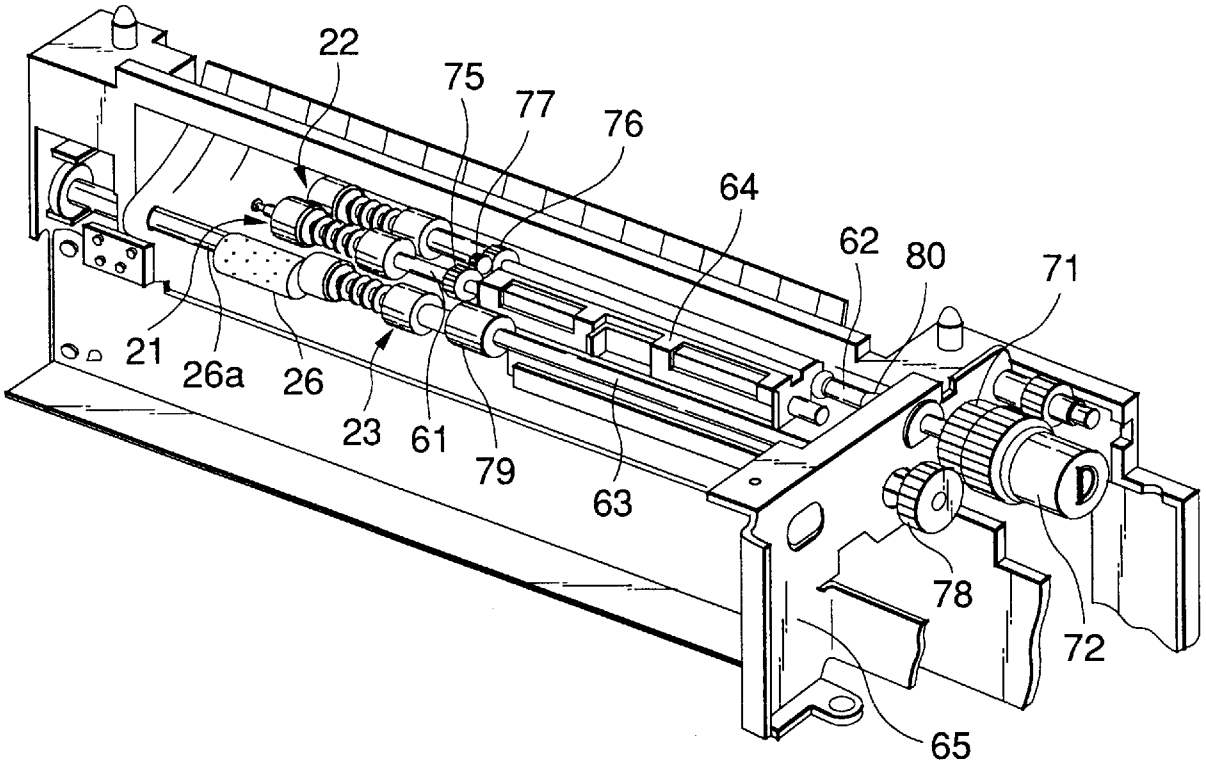
FIG. 3 is a perspective view of paper feed rolls and their peripheral devices.

As shown in FIGS. 3 and 5, a drive gear 71 is attached via a feed clutch 72 to the deep end from the machine frame 65 in the feed roll 22. The drive gear 71 is coupled to a feed motor 74 via an intermediate gear 73 supported on the machine frame 65. The power of the feed motor 74 is transmitted from the intermediate gear 73 to the drive gear 71 and when the feed clutch 72 is connected, the feed roll shaft 62, namely, the feed roll 22 is rotated in the forward direction in which a sheet S is fed. A gear 75 is fixed between the naja roll 21 and the arm 64 in the naja roll shaft 61 and a gear 76 is fixed between the feed roll 22 and the arm 64 in the feed roll shaft 62. The gears 75 and 76 are coupled to each other via an intermediate gear 77 supported rotatably on the arm 64. When the feed roll shaft 62 rotates, rotation of the gear 75 on the feed roll shaft 62 side is transmitted through the intermediate gear 77 to the gear 76 on the naja roll shaft 61, whereby the naja roll 21 is rotated in the forward direction together with the feed roll 22.

On the other hand, a retard gear 78 is fixed to the deep side of the machine frame 65 in the retard roll shaft 63 and in a paper feed state in which the retard roll 23 comes in contact with feed roll 22, the retard gear 78 meshes with an intermediate gear (not shown) meshing with the feed roll 22. When the feed roll shaft 62 rotates, rotation of the drive gear 71 is transmitted through the intermediate gear (not shown) to the retard gear 78, whereby the retard roll 23 is rotated in the same rotation direction as the feed roll 22, namely, in the opposite direction to the sheet S feed direction. A torque limiter 79 lies between the retard roll shaft 63 and the retard roll 23. Normally, a drive force acts on the retard roll 23 in the opposite paper feed direction as the feed motor 74 operates. When a plurality of sheets of paper enter the nip portions 67, the retard roll 23 rotates in the opposite paper feed direction. When the retard roll 23 comes in contact with the feed roll 22 or one sheet S is sandwiched therebetween, a given friction force or more is transmitted from the feed roll 22 and the torque limiter 79 works. The retard roll 23 rotates with the feed roll 22, namely, rotates in the paper feed direction.

That is, in the normal paper feed state in which the top sheet S is drawn out by the naja roll 21, the retard roll 23 rotates in the paper feed direction as the feed roll 22 rotates. If two or more sheets S are drawn out at the same time due to the friction between the sheets S, static electricity, etc., and enter the nip portions 67, the friction force of the feed roll 22 is canceled between the sheets S, the retard roll shaft 63 and the retard roll 23 are coupled via the toque limiter 79, and the retard roll 23 is rotated in the opposite paper feed direction as the feed motor 74 operates. Then, the sheet S under the top sheet S is returned to the paper feed tray 19 by the rotation of the retard roll 23, whereby feeding of more than one sheet S in overlapped relation is prevented. When the sheets S are thus prevented from being fed in overlapped relation, one sheet S is sandwiched between the feed roll 22 and the retard roll 23 and again the retard roll 23 is rotated in the paper feed direction.

A one-way clutch 80 for allowing the feed roll shaft 62 to rotate only in the paper feed direction is placed in the vicinity of the machine frame 65 in the feed roll shaft 62. The role of the one-way clutch 80 is as follows: When the tip of a sheet S arrives at the registration roll 24, the sheet S is stopped here and the paper feed operation is continued, whereby the sheet S is bent like a loop and its transport attitude is adjusted straight. At this time, if the feed roll shaft 62 is reversed, the rear end of the sheet S is pulled in the opposite direction to the paper feed and no loop is made; the transport attitude of the sheet S is not adjusted. This problem is caused by the feed roll shaft 62 which is reversed. Thus, the one-way clutch 80 is placed in the feed roll shaft 62 so as to prevent the feed roll shaft 62 from being reversed.

The transport roll 26 rotates in the transport direction. Since the roll shaft 26 adjacent to the bottom stage is placed out of the sheet transport passage 25, the transport roll 26 is not required. Thus, a gear 70 is not fixed and the roll shaft **26*a* is provided as a member for simply supporting the retard bracket 66**.

Figure 8:
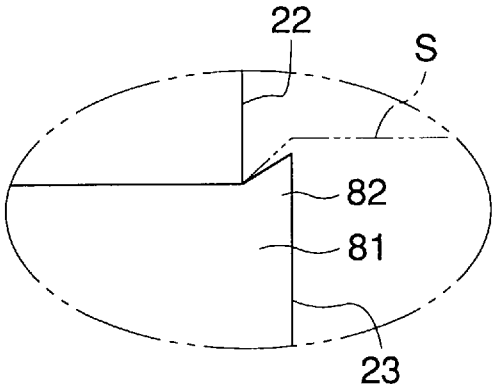
FIG. 8 is an enlarged view of the VIII part in FIG. 7.

As shown in FIG. 7, the retard roll 23 is slightly offset axially from the feed roll 22 to the front side of the main unit 2. Therefore, when both rolls 22 and 23 come in elastic contact with each other for forming nip portions 67 in the placement state, the front end of the retard roll 23 projects to the front side as compared with the feed roll 22, forming a projection 81. This projection 81 projects in the opposite direction to the retard bracket 66 relative to the axial direction of the retard roll 23. Since the retard roll 23 is made of an elastic body such as rubber, the part of the retard roll 23 with which the feed roll 22 comes in elastic contact is slightly crushed under pressure of the feed roll 2 and the projection 81 diametrically swells accordingly. FIG. 8 shows the swell 82. This swell 82 is formed so as to rise as it is distant from the feed roll 22 because of the effect of the pressure of the feed roll 2. Preferably the projection 81 is about 2 mm long if the feed roll 22 and the retard roll 23 are about 20 mm in diameter, for example.

B: Operation of First embodiment

Next, the operation of the copier 1 will be discussed mainly centering around the paper feed operation of the paper feed rolls 20.

First, to set an original document, the user places the original document on the copy glass 11 and closes the original cover 12 or stores the original document in the original tray 13 of the automatic original feeder with the original cover 12 closed. The user selects a paper feed tray 19 matching the size and orientation of the target sheet S as necessary and presses the copy start button on the operation panel 18. The bottom plate 51 of the paper feed tray 19 for storing the sheet S matching the original document if the automatic selection mode of the size and orientation of the sheet S is applied or the bottom plate 51 of the selected paper feed tray 19 if the user selects the tray 19 is lifted up by the lift plate 51 operated by the lift-up motor 55, causing the top sheet S in the paper feed tray 19 to come in contact with the lower peripheral surface of the naja roll 21. The retard roll 23 comes in contact with the feed roll 22 as the retard bracket 66 turns. The feed motor 74 is operated at the same time as the operation start button is pressed. The power of the feed motor 74 causes the feed roll 22 and the naja roll 21 to rotate in the sheet S feed direction and further, as the feed roll 22 rotates, the naja roll 21 coming in contact with the feed roll 22 rotates in the feed direction.

The top sheet S coming in contact with the naja roll 21 is drawn out in the paper feed direction by the naja roll 21 and the tip of the sheet S enters the nip portions 67 between the feed roll 22 and the retard roll 23. The sheet S entering the nip portions 67 is fed into the sheet transport passage 25 by rotation of the feed roll 22 and the retard roll 23. If the sheet S is fed from the uppermost paper feed tray 19, it is transported to the registration roll 24 as it is; the sheet S fed from any other paper feed tray 19 is transported to the registration roll 24 by the transport roll 26 disposed at an intermediate point on the sheet transport passage 25. Next, the sheet S is adjusted in the transport attitude and the transport timing by the registration roll 24 and is transported to the portion between the transfer roll 33*a* and the photosensitive drum 31 in the image formation section 3.

On the other hand, an image signal of the original read through the reader 14 is formed as an electrostatic latent image on the photosensitive drum 31 in the image formation section 3 and the electrostatic latent image is developed by the developing unit 32. The developed image is transferred to the sheet S (a first side facing the photosensitive drum 31) passing through the space between the transfer roll 33*a* and the photosensitive drum 31. The sheet S to which the image is transferred passes through between the heating roll 34*a* and the pressurizing roll 34*b* of the fuser 34 and meanwhile the image is fixed on the sheet S. The sheet S passing through the fuser 34 is guided toward the direction of the paper discharge tray 36 by the gate 37. In the single-sided copy mode, the sheet S is discharged to the paper discharge tray 36 by the first paper discharge roll 41 as it is. If the double-sided copy mode is selected, when the rear end of the sheet S reaches the position at which it is held on the paper discharge roll 41, the gate 37 is switched, next the first paper discharge roll 41 is reversed and the sheet S is inverted and is transported by the second paper discharge roll 42 to the automatic double-sided unit 5. After this, the sheet S is again transported to the main unit 2 by the transport roll 46 and an image is formed on a second side of the sheet S, then the sheet S is discharged to the paper discharge tray 36.

We have discussed the copy process of the copier 1. Next, the function of the feed roll 22 and the retard roll 23 according to the invention will be discussed.

The feed roll 22 and the retard roll 23 are fixed to the feed roll shaft 62 and the retard roll shaft 63 as described above and the feed roll shaft 62 and the retard roll shaft 63 are of a one support structure for supporting the deep side. Because of the one support structure, the nip pressure on the front side opposite to the support side tends to lessen in the nip portions 67. When such nip pressure imbalance occurs, if more than one sheet S drawn out by the naja roll 21 enters the nip portion 67, transport resistance on the front side lessens and the transport force on the front side substantially grows, causing a skew in which the sheet S is placed in skew transport attitude with the tip of the sheet S directed toward the deep side.

However, in the embodiment, the retard roll 23 is disposed on the front side relative to the feed roll 22, forming the projection 81, which becomes the swell 82 on the front side of the nip portions 67. This swell 82 regulates more than one sheet S entering the nip portions 67 on the front side of the retard roll 23. Resultantly, a skew is suppressed. If a skew is thus suppressed, the image formed on the sheet S by the image formation section 3 becomes normal as the original and the image quality is improved. In the embodiment, the paper feed rolls 20 are offset slightly to the front side from the center of the width direction of the paper feed tray 19, thus a skew with the tip of the sheet S directed toward the deep side especially easily occurs. However, the skew is suppressed effectively by the function described above. In the embodiment, to suppress the skew, the retard roll 23 is simply offset to the opposite support side from the feed roll 22 without changing the roll shape or adopting a both-support structure for the rolls as in the conventional apparatuses. Thus, the number of parts does not increase and the structure is also simple. The retard roll 23 can be made common to the naja roll 21 and the feed roll 22. Thus, assembly can be improved and the manufacturing costs can be reduced.

Next, second to fourth embodiments of the invention will be discussed. Components identical with or similar to those of the first embodiment previously described with reference to FIGS. 1 to 8 are denoted by the same reference numerals in FIGS. 9 to 14 and will not be discussed again.

Figure 9:
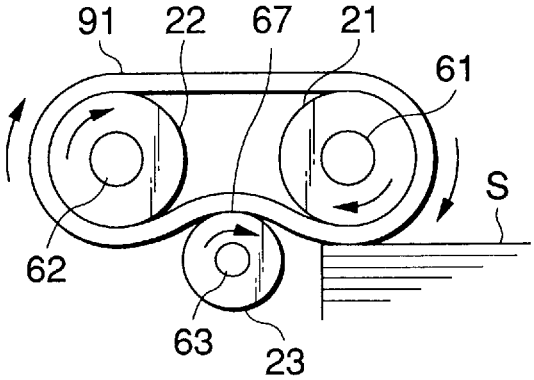
FIG. 9 is a front view to show the main part of a second embodiment of the invention.
Figure 10:
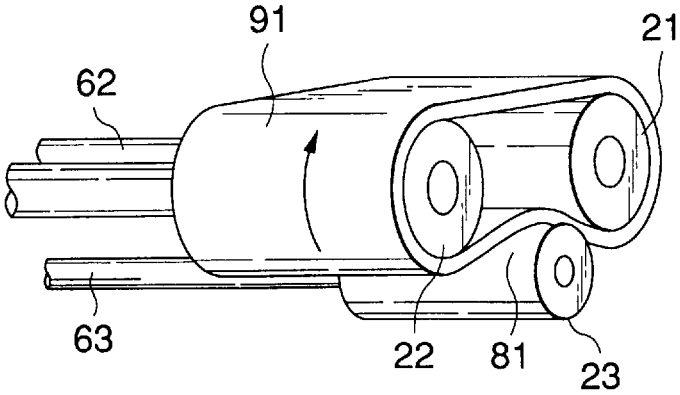
FIG. 10 is a perspective view to show the main part of the second embodiment of the invention.

Second embodiment: FIGS. 9 and 10

In a second embodiment of the invention, an endless belt 91 (friction member, rotation member) is placed on a naja roll 21 fixed to a naja roll shaft 61 and a feed roll 22 fixed to a feed roll shaft 62. Rotation of the feed roll 22 is transmitted via the belt 91 to the naja roll 21 and the belt 91 and the naja roll 21 are rotated in the paper feed direction indicated by the arrow. A retard roll 23 fixed to a retard roll shaft 63 is disposed below the space between the naja roll 21 and the feed roll 22. When the naja roll 23 is lifted up at the paper feed time, it comes into elastic contact with the outer peripheral surface of the belt 91, forming a nip portion 67 between the naja roll 23 and the belt 91. At this time, the belt 91 maintains a given tension by the retard roll 23. When a large number of sheets S stored in a paper feed tray (not shown) are lifted up, the top sheet S is drawn out by the belt 91, passes through the nip portion 67 between the belt 91 and the retard roll 23 rotating in the paper feed direction by the friction force of the belt 91, and is transported. When more than one sheet S drawn out by the belt 91 is about to be transported in overlapped relation, the retard roll 23 blocks it as in the first embodiment.

As shown in FIG. 10, the retard roll 23 is offset slightly to the front side (opposite support side) from the naja roll 21 and the feed roll 22, forming the nip portion 67, forming a projection 81 on the front side. In the projection 81, a swell similar to that shown in FIG. 8 is formed by pressure of the belt 91 for regulating more than one sheet S entering the nip portion 67 at the retard roll 23 on the front side, thereby suppressing a skew wherein the tip of the sheet S is directed toward the deep side.

Figure 11:
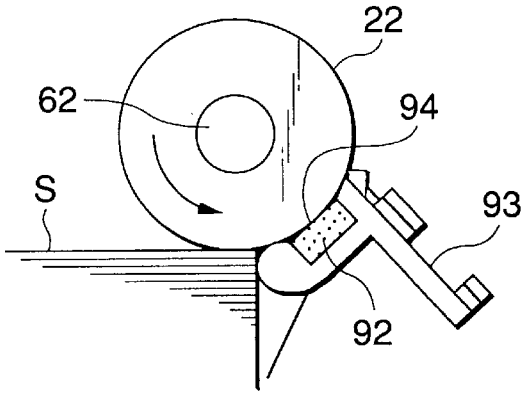
FIG. 11 is a front view to show the main part of a third embodiment of the invention.
Figure 12:
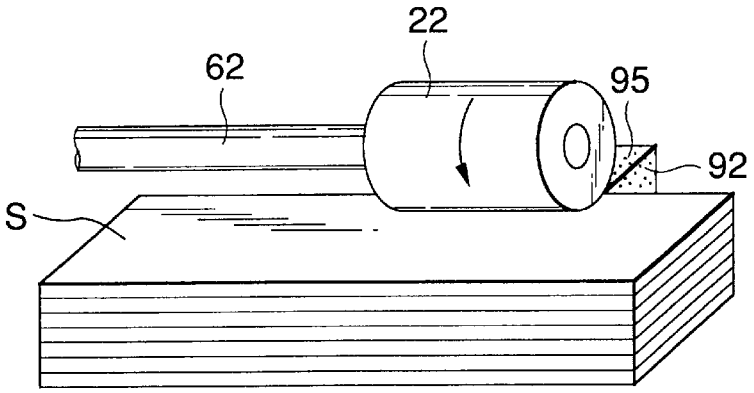
FIG. 12 is a perspective view to show the main part of the third embodiment of the invention.

Third embodiment: FIGS. 11 and 12

In a third embodiment of the invention, the naja roll 21 in the first and second embodiments is omitted and a retard pad 92 is placed facing a feed roll 22 as a friction member in place of the retard roll 23 in the first and second embodiments. The retard pad 92 is attached to a bracket 93 supported on a main unit (not shown) and is inclined toward a paper feed direction. It is made of an elastic body such as rubber and has a surface coming in elastic contact with the peripheral surface of the feed roll 22, forming a nip portion 94 therebetween. In this case, when the feed roll 22 rotates, the top sheet S is drawn out. At the time, if more than one sheet S is about to be transported in overlapped relation, the lower sheet S is blocked by the friction force of the retard pad 92, preventing transporting of more than one sheet S in overlapped relation.

The retard pad 92 has a width set slightly longer than the axial length of the feed roll 22. The deep (left in FIG. 12) end of the retard pad 92 matches the peripheral margin of the deep side of the feed roll 22 or is positioned slightly on the front side, whereby the front end (on the opposite support side) projects slightly to the front side from the nip portion 94, forming a projection 95. In the projection 95, a swell similar to that shown in FIG. 8 is formed by pressure of the feed roll 22 for regulating more than one sheet S entering the nip portion 94 at the retard pad 92 on the front side, thereby suppressing a skew wherein the tip of the sheet S is directed toward the deep side.

Figure 13:
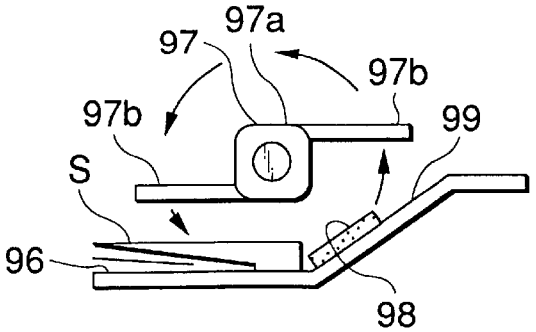
FIG. 13 is a front view to show the main part of a fourth embodiment of the invention.
Figure 14:
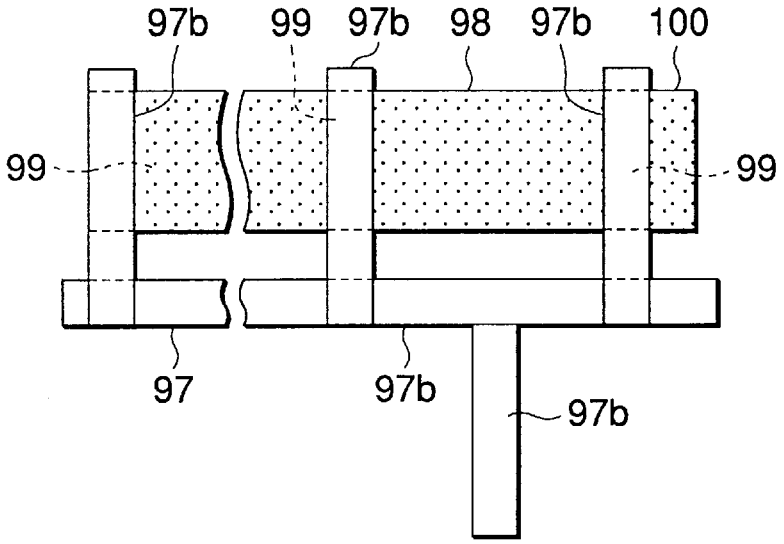
FIG. 14 is a top view to show the main part of the fourth embodiment of the invention.

Fourth embodiment: FIGS. 13 and 14

A fourth embodiment of the invention is provided by applying the invention to original feed means adopted for the above-mentioned automatic original feeder, etc. Numeral 96 in FIG. 13 is an original tray for storing sheets S as a plurality of original document sheets (sheet storage section). The sheets S are fed by a paddle 97 and a retard pad 98. The paddle 97 is made up of a paddle shaft 97*a* and a plurality of paddle bodies 97*b* orthogonal to the paddle shaft 97*a* and fixed at one end. The paddle bodies 97*b* are made of flexible elastic bodies such as rubber and are placed on both sides of the paddle shaft 97*a* alternately. The retard pad 98, which is made of an elastic body such as rubber, is spaced from the paddle shaft 97*a* at a predetermined interval and extends in the width direction of the fed sheet S and is put on the surface of the original tray 96. The paddle shaft 97*a* is of a one support structure wherein it is supported at one end (the drawing front in FIG. 13 or the left in FIG. 14) rotatably on a support portion (not shown) and has the opposite end as a free end.

In this case, the paddle 97 rotates in the arrow direction in FIG. 13, whereby the paddle body 97*b* comes in contact with the top sheet S on the original tray 96 while it is bent. The sheet S is drawn out by the paddle 97*b*, passes through a nip portion 99 formed between the tip of the paddle body 97*b* and the retard pad 98, and is fed. At the time, if more than one sheet S is about to be transported in overlapped relation, the lower sheet S is blocked by the friction force of the retard pad 98, preventing transporting of more than one sheet S in overlapped relation.

FIG. 14 is a top view. As shown here, the front end of the retard pad 98 matches the end margin of the paddle 97*b* on the front side (the support side of the paddle shaft 97*a*), but the end of the deep side (the opposite support side of the paddle shaft 97*a*) projects slightly to the deep side further from the paddle shaft 97*b* on the deepest side, forming a projection 100. In the projection 100, a swell similar to that shown in FIG. 8 is formed by pressure of the paddle body 97*b* for regulating more than one sheet S entering the nip portion 99 at the retard pad 98 on the deep side, thereby suppressing a skew wherein the tip of the sheet S is directed toward the deep side.

Also in the second to fourth embodiments, the retard roll 23 or the retard pad 92, 98 is simply offset to the opposite support side from the feed roll 22 or the paddle body 97*b* without changing the roll shape or adopting a both-support structure for the rolls; while the number of parts does not increase and the structure is not complicated, a skew is suppressed.

The invention is not limited to the embodiments and can be applied to any forms if the sheet feed means and the friction member for preventing transporting of more than one sheet in overlapped relation are sheet feed or transport means in the form wherein they are placed facing each other with a nip portion formed therebetween. The important point is that a projection of the friction member is formed only on the side for regulating disorder of the sheet transport attitude and is made of a material that can be swollen by the feed means.

According to the invention, a skew is suppressed simply by forming a projection in the friction member without changing the roll shape or adopting a both-support structure for the rolls as in the conventional apparatuses. Resultantly, the number of parts does not increase and the structure is not complicated; the manufacturing costs can be reduced.

What is claimed is:

1. An image formation apparatus for use with multiple sheets, comprising:

a main unit including an image formation section;

a sheet storage section disposed in said main unit for storing multiple stacked sheets;

feed means for communicating a transport force to at least one sheet of the multiple sheets in said sheet storage section in a predetermined sheet feeding direction from said sheet storage section;

a friction member disposed so as to oppose and elastically contact said feed means, the feed means and friction member forming a nip portion that extends in a nip extension direction for separating sheets transported in overlapped relation, the friction member including a projection that projects from the nip portion; and a support member for supporting said friction member such that the projection of the friction member projects from the nip portion at an angle relative to the nip extension direction so as to grip a sheet disposed in the nip portion to prevent the sheet from becoming skewed relative to the sheet feeding direction.

2. The image formation apparatus of claim 1, wherein said feed means and said friction member each have substantially the same structure, and are offset relatively in the nip extension direction so as to form said projection of the friction member.

3. The image formation apparatus of claim 1, wherein said feed means includes;

a shaft member supported rotatably on said main unit, and a rotation member attached to said shaft member, wherein at least either of said shaft member and said support member is a one support structure, wherein said shaft member is supported only at one axial end on a support portion of said main unit, and said projection projects in an opposite direction to said support portion from said nip portion.

4. The image formation apparatus of claim 1, wherein said feed means includes;

a first shaft member supported rotatably on said main unit, and a first roll member attached to said first shaft member, said support member includes;

a second shaft member supported rotatably on said main unit; and said friction member includes;

a second roll member attached to said second shaft member, wherein at least either of said first and second shaft members is of a one support structure, wherein said shaft member is supported only at one axial end on a support portion of said main unit, and said second roll member defines the projection projecting in an opposite direction to said support portion from said nip portion formed between said first and second roll members.

5. The image formation apparatus of claim 4, wherein said first and second roll members have substantially the same structure, and are offset relatively in an axial direction so as to form said projection.

6. The image formation apparatus of claim 1, further comprising:

drive means for rotating a shaft member in a direction of returning at least one sheet to said sheet storage section, when a plurality of sheets are transported from said sheet storage section to said nip portion in overlapped relation, wherein said support member includes the shaft member supported rotatably on said main unit, said friction member includes a roll member attached to said shaft member.

7. The image formation apparatus of claim 6, wherein said roll member is rotated in a sheet feed direction by a transport force of said feed means, if a plurality of sheets are not disposed in said nip portion.

8. The image formation apparatus of claim 1, wherein a center of said nip portion and a center line of a sheet fed from said sheet storage section, the center line extending in a direction orthogonal to the sheet feeding direction, are offset in the direction orthogonal to the sheet transport direction.

* * * * *